United States Patent [19]

Rochman

[11] Patent Number: 4,508,378

[45] Date of Patent: Apr. 2, 1985

[54] DOOR LOCKING DEVICE

[76] Inventor: Zvi H. Rochman, 21 Brodetski St., Netanya, Israel

[21] Appl. No.: 473,637

[22] Filed: Mar. 9, 1983

[30] Foreign Application Priority Data

Jul. 7, 1982 [IL] Israel ..... 66249

[51] Int. Cl.[3] ..... E05C 9/02

[52] U.S. Cl. ..... 292/333

[58] Field of Search ..... 292/333, 335, 166, 35, 292/150, 94

[56] References Cited

U.S. PATENT DOCUMENTS 1,554,813 9/1925 Gjukic ..... 70/110

1,831,117 11/1931 Huston ..... 292/93

FOREIGN PATENT DOCUMENTS 2378160 9/1978 France ..... 292/35

2431590 3/1980 France ..... 292/333

*Primary Examiner*—Richard E. Moore

*Attorney, Agent, or Firm*—Benjamin J. Barish

[57] ABSTRACT

A door locking device comprises a locking bolt movable from a retracted position within the door edge, to a projected position for locking the door within the door frame, and a feeler member engageable with the door frame when the door is in its closed position to automatically actuate the locking bolt to its projected position, and thereby to automatically lock the door in its closed position. The automatic locking of the door may be disabled either by the application of a proper key in the key cylinder, or by the depression of a foot pedal. The described embodiment includes two locking bolts both of substantial vertical length so that together they occupy at least 50% of the door height.

14 Claims, 4 Drawing Figures

DOOR LOCKING DEVICE

BACKGROUND OF THE INVENTION

The present invention relates to door locking devices, and particularly to the type including one or more locking bolts which are movable to their locking position by a key-operated cylinder.

Many different constructions of door-locking devices of the foregoing type have been developed and are commercially available. In the more popular constructions, after the door has been closed, the user must perform additional manipulations (e.g., insert the key and rotate the cylinder) in order to securely lock the door in its closed condition. While doors frequently have spring-actuated latches which are actuated by merely closing the door, these latches can usually be opened by an authorized person without too much difficulty and therefore do not provide secure protection when the door is closed, the secure protection being usually provided only by the additional manipulations on the part of the user, such as the insertion and rotation of his key and/or the rotation of the door handle. As a result, a user frequently merely closes the door, and thereby leaves the door protected against unauthorized opening only by the spring-latch which, as mentioned above, does not provide secure protection.

BRIEF SUMMARY OF THE INVENTION

An object of the present invention is to provide a door locking device having advantages in the above respects.

According to a broad aspect of the present invention, there is provided a door locking device comprising: a locking bolt movable to a retracted position to release the door for opening and closing movements within a door frame, or to a projected position to lock the door in its closed position within the doorframe; a coupling member coupled to the locking bolt and biased from an unlocking position retracting the bolt to a locking position projecting the bolt to lock the door in its closed position within the door frame; and a manually-operated mechanism including a first latching pin manually movable to a first position for latching the coupling member in its locking position, or to a second position for unlatching the coupling member and permitting it to move under its bias to its locking position. The door locking device further includes a feeler member biased to a projected position to project past the door and engageable with the door frame, when the door is in its closed position, so as to be moved to a retracted position. The locking device further includes a second latching pin coupled to the feeler member such that when the feeler member is in its projected position, the second latching pin also latches the coupling member in its locked position but is effective, when the feeler member engages the door frame in the closed position of the door, to automatically unlatch the coupling member, permitting same to move under its bias to its locking position and to move the locking bolt to its projected position locking the door in its closed position within the door frame.

In the described preferred embodiment, the manually-operated mechanism comprises a key-operated cylinder for manually moving the first latching pin either to its first position latching the coupling member in its locking position, or to its second position releasing the coupling member from its locking position.

The locking device further includes a spring biassing the mentioned first latching pin to its latching position for latching the coupling bar in its locking position, and retaining means effective when actuated, to retain the coupling bar in its unlocking position. The latter retaining means may be effective to retain the first latching pin in its unlatching position when the key-operated cylinder is rotated by the proper key; alternatively, the latter retaining means may include, in lieu of or in addition to the foregoing, a foot pedal coupled to the coupling bar to retain it in its unlocking position when the foot pedal is depressed.

According to a still further feature, there are two locking bolts in vertical alignment and both of substantial vertical length, such that together they occupy a substantial portion, e.g., at least 50% of the vertical height of the door. Both of the locking bolts are coupled to the coupling bar by a pair of slide bars coupled to the latter, and a plurality of bell-crank levers coupled between the slide bars and the locking bolts.

Further features and advantages of the invention will be apparent from the description below.

BRIEF DESCRIPTION OF THE DRAWINGS

The invention is herein described, by way of example only, with reference to the accompanying drawings, wherein.

DESCRIPTION OF THE PREFERRED EMBODIMENT

Figure 1:
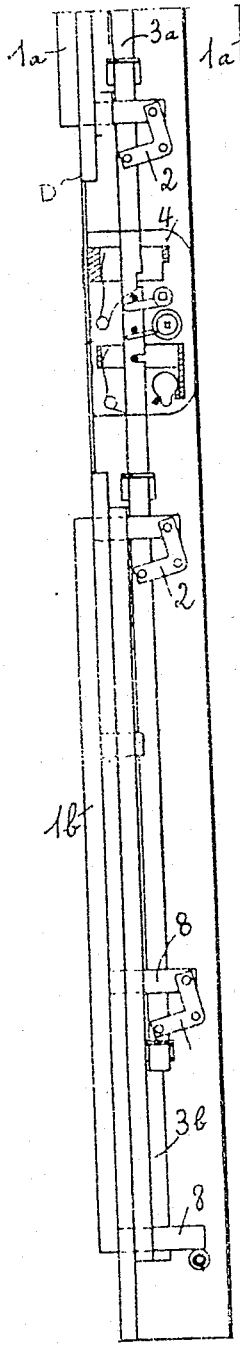
FIG. 1 illustrates one form of door locking device constructed in accordance with the present invention.
Figure 2:
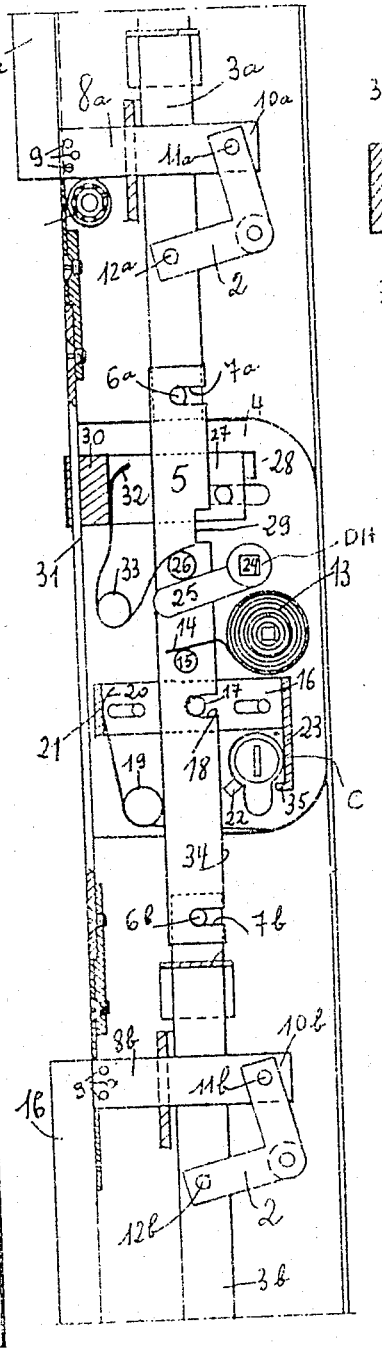
FIG. 2 is an enlarged fragmentary view of a portion of the door locking device of FIG. 1, showing the elements in their door-locking positions.

The door locking device illustrated in the drawings comprises a pair of locking bolts 1*a*, 1*b* movable either to a locking position, as illustrated in FIGS. 1 and 2, wherein they project past the edge of the door D, or to a retracted position flush with, or slightly recessed within, the door. In the illustrated embodiment, there are two of such locking bolts 1*a*, 1*b*, in vertical alignment with each other and both of substantial vertical length; e.g., each is at least 25% of the door height so that together they occupy at least 50% (preferably more) of the door height.

The two locking bolts 1*a*, 1*b* are coupled to two vertically-aligned slide bars 3*a*, 3*b* by means of a plurality of bell-crank levers 2, such that the vertical movement of the slide bars 3*a*, 3*b* is translated to a horizontal movement of the locking bolts 1*a*, 1*b*.

The locking device further includes a lock housing 4 mounted centrally of the door between the two locking bolts 1*a*, 1*b*. Housing 4 contains a vertically-movable coupling 5 which projects from the housing and is coupled, on its opposite sides, to the two slide bars 3*a*, 3*b* via pins 6*a*, 6*b* carried by the slide bars receivable within slots 7a, 7b formed in the two ends of the coupling bar 5. Coupling bar 5 is actuated by a key-operated cylinder contained within the housing 4, and also by the door handle passing through the housing 4, as will be described more particularly below.

For coupling the locking bolts 1a, 1b to the slide bars 3a, 3b via the bell-crank levers 2, a link 8a, 8b is fixed, as by welding 9, to each of the two locking bolts 1a, 1b. The opposite side 10a, 10b of each link is pivotably mounted, at 11a, 11b, to one leg of the respective bell-crank lever 2, the opposite leg of each such lever being pivotably mounted, at 12a, 12b, to the respective slide bars 3a, 3b. Thus, when the two slide bars 3a, 3b are moved vertically downwardly, the bell-crank levers 2 cause the locking bolts 1a, 1b to move horizontally outwardly to their projecting, locking positions.

The two slide bars 3a, 3b, being coupled to the coupling bar 5 within the lock housing 4 via pins 6a, 6b and slots 7a, 7b as mentioned earlier, are biased downwardly to the locking positions of the bolts 1a, 1b by means of a torsion spring 13 disposed within the lock housing 4 having an end 14 pressing against a pin 15 carried by the coupling bar 5. The coupling bar 5 may be locked in the down position by means of a key-operated member or slide 16 carrying a latch pin 17 received within a notch 18 formed in the coupling bar 5. Slide 16 is biased to this latching position by means of a piano spring 19 having an end 20 pressing against an out-turned end 21 to the slide 16.

Slide 16 may be moved (rightwardly in FIG. 2, to the position shown in FIG. 3) by the key-operated cylinder C provided within lock housing 4, particularly by the tooth 22 which is rotated, upon rotation of the cylinder, to engage a depending end element 23 formed at the end of slide 16 and to move the slide rightwardly when the cylinder is rotated by the proper key. Upon the release of the coupling bar 5 for vertical movement in this manner, the bar may be moved vertically upwardly by rotating the door handle DH, particularly the square nut 24 of the door handle which has a lever arm 25 engaging a pin 26 carried by the coupling bar 5, so as to lift the bar upon the clockwise rotation of the door handle.

Figure 3:
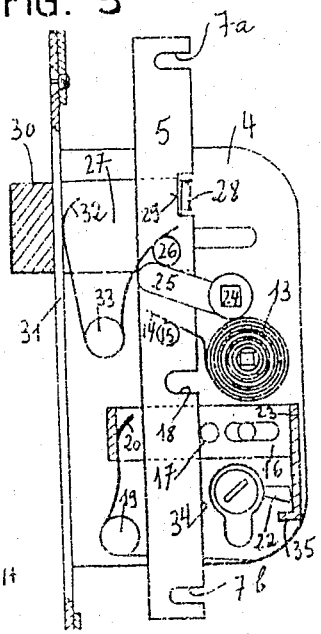
FIG. 3 is an enlarged fragmentary view illustrating a portion of the door locking device of FIGS. 1 and 2, but showing the elements in their door-unlocking positions.

The illustrated locking device further includes a feeler member 27 carrying, at its inner end, a second latching pin 28 which is adapted to be received within a notch 29 formed in the portion of the coupling bar 5 disposed within the lock housing 4. As shown particularly in FIG. 3, when latching pin 28 is received within notch 29 of the coupling bar (which occurs when the coupling bar is in its raised, unlocking condition), a finger 30 of the feeler member 27 projects past the free edge 31 of the door, as shown in FIG. 3. The inner face of this projecting finger 30 is engaged by the free end 32 of a piano spring 33, which spring thus biases the feeler member to this position illustrated in FIG. 3. In this raised, unlocking position of the coupling bar 5, the latching pin 17 in slide 16 is not received within notch 18 of the coupling bar, but rather engages the edge 34 of the coupling bar, as also seen in FIG. 3.

Insofar as described above, the locking device operates as follows:

First, it is to be noted that FIG. 2 illustrates the above-described elements of the locking device in the positions they assume when the door is closed and locked; i.e., with the locking bolts 1a, 1b in their locking positions projecting past the edge 31 of the door. In this condition, it will be seen that the coupling bar 5, and also the slide bars 3a, 3b, are in their lower vertical positions. It will also be seen that the coupling bar 5 is locked in this lower position by means of the latching pin 17 carried by slide 16 received within notch 18 formed in the coupling bar, slide 16 being biased in this position by piano spring 19 engaging end 21 of the slide. It will further be seen that in this closed, locking condition of the door, feeler member 27 is in its retracted position since its finger 30 engages the door frame, thereby moving the feeler member inwardly against the action of spring 33, to unseat its latching pin 28 from notch 29 of the coupling bar 5.

In order to open the door, it first must be unlocked by inserting a proper key within the cylinder C and by rotating the cylinder, whereupon tooth 22 of the cylinder is rotated clockwise to engage end element 23 of slide 16. This causes the slide 16 to move (rightwardly in FIG. 2) to the position illustrated in FIG. 3, thereby unseating latching pin 17 from notch 18 of the coupling bar and freeing the coupling bar for vertical movement. After the coupling bar has thus been freed for vertical movement, the door handle DH is rotated, to thereby rotate the square nut 24 clockwise, causing its lever arm 25, engaging pin 26 carried by the coupling bar 5, to lift the coupling bar in the vertical direction. This lifting movement of the coupling bar is transferred to the two slide bars 3a, 3b, which, via the bell-crank levers 2, move the two locking bolts 1a, 1b horizontally, to retract them within the edge 31 of the door.

The door is thus unlocked, and it may be manually opened by means of the door handle DH.

The upward movement of the coupling bar 5 by rotating the door handle DH moves the coupling bar a sufficient vertical distance to bring its notch 29 into alignment with latching pin 28 formed in the feeler member 27, thereby permitting the feeler member to be moved, by spring 33, to its projected position wherein its finger 30 projects past the edge 31 of the door. Thus, when the door is opened, feeler member 27 is in its projected position illustrated in FIG. 3, which projected position retains the coupling bar in its raised condition by virtue of the seating of latching pin 28 within notch 29, and thereby retains the locking bolts 1a, 1b in their retracted, non-locking conditions.

When the door is manually closed, projecting finger 30 of the feeler member 27 engages the door frame and is moved thereby (rightwardly in FIG. 3), to unseat latching pin 28 from notch 29 of the coupling bar 5. The coupling bar is thus free to move downwardly by the action of torsion spring 13 whose end 14 bears against pin 15 of the coupling bar. This downward movement of the coupling bar causes the slide bars 3a, 3b to also move downwardly. These downward movements are translated, via the bell-crank levers 2, to a horizontal movement to the locking bolts 1a, 1b, thereby moving these bolts to their projected, locking positions as illustrated in FIGS. 1 and 2. Coupling bar 5 is moved downwardly by the torsion spring 13 until latching pin 17 of slide 16 seats within notch 18 of coupling bar 5, thereby securely latching this coupling bar in its down, locking condition with respect to the locking bolts 1a, 1b.

It will thus be seen that the mere closing of the door, without any further manipulation of the part of the user, automatically actuates the locking bolts 1a, 1b to their projecting, locking positions.

Should it be desired to prevent this automatic locking to occur by merely closing the door, the user may retain the key-operated cylinder C in the actuated condition, wherein tooth 22 is rotated to engage end element 23 of slide 16. End element 23 is preferably formed with another bend 35 acting as a stop to prevent the continuous rotation of the cylinder, so that when tooth 22 of the cylinder engages end stop 35, the cylinder C may be retained in that condition with the key still within the cylinder. This prevents slide 26 from returning to its normal position, under the action of spring 19, thereby also preventing latching pin 17 carried by the slide from being received within notch 18 in the coupling bar 5. Accordingly, the coupling bar will not be latched in its lower, locking condition, so that the door can be opened and closed by merely using the handle DH coupled to the lever arm 25.

If, however, the automatic locking operation is to be effective, the user, after opening the lock by rotating the cylinder C in one direction until its tooth 22 engages end stop 35 on slide 16, would rotate the cylinder in the opposite direction to bring the cylinder tooth 22 back to the position illustrated in FIG. 2. In this manner, the automatic operation of the door locking device is enabled automatically upon closing the door, to actuate the locking bolts 1*a*, 1*b* to their locking positions and to latch them in this locking position.

Figure 4:
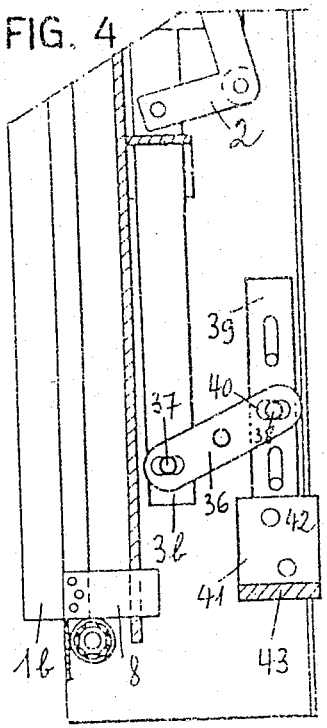
FIG. 4 is an enlarged fragmentary view illustrating the lower part of the door-locking mechanism of FIG. 1, particularly illustrating a foot pedal which may be used for disabling the automatic operation of the door-locking mechanism.

The automatic locking operation may also be disabled by the depression of a foot pedal provided on the door D, particularly as illustrated in FIG. 4. Thus, as shown in FIG. 4, the lower end of the door is provided with a link 36 formed at one end with an elongated slot receiving a pin 37 carried at the lower end of the lower slide bar 3*b*. Cooperable with the opposite end of link 36 is a pin 38 carried by a slide plate 39, which pin is receivable within another elongated slot 40 formed in the respective end of link 36. Slide plate 39 is fixed to a foot pedal 41 and is formed with a pair of vertically-elongated slots each receiving a pin 42 carried by the door. The lower end of foot pedal 41 is formed with a horizontal projection 43 engageable by the user's foot to permit depression of the foot pedal.

Thus, when the foot pedal 41 is depressed, link 36 is pivoted to move the lower slide bar 3*b* to its upper position, and thereby also to move the coupling bar 5 and the upper slide bar 3*a* also to their upper positions, so that both slide bars 3*a*, 3*b* and the coupling bar 5 are all retained in their upper positions, thereby retaining the locking bolts 1*a*, 1*b* in their retracted, unlocking conditions.

While the invention has been described with respect to one preferred embodiment, it will be appreciated that many variations, modifications and other applications of the invention may be made.

What is claimed is:

1. A door locking device, comprising:

a locking bolt movable to a retracted position to release the door for opening and closing movements within a door frame, or to a projected position to lock the door in its closed position within the door frame;

a coupling member coupled to said locking bolt and biased from an unlocking position retracting said bolt, to a locking position projecting said bolt to lock the door in its closed position within the door frame;

a manually-operated mechanism including a first latching pin manually movable to a first position for latching said coupling member in its locking position, or to a second position for unlatching said coupling member and permitting same to move under its bias to its locking position;

a feeler member biased to a projected position to project past the door and engageable with the door frame when the door is in its closed position so as to be moved to a retracted position;

and a second latching pin coupled to said feeler member such that when the feeler member is in its projected position said second latching pin also latches said coupling member in its locked position but is effective, when the feeler member engages the door frame in the closed position of the door, to automatically unlatch said coupling member permitting same to move under its bias to its locking position and to move said locking bolt to its projected position locking the door in its closed position within the door frame.

2. The locking device according to claim 1, wherein said coupling member is biased to its locking position by a spring.

3. The locking device according to claim 1, wherein said coupling member is a coupling bar formed with a pair of spaced notches; said first latching pin being seated in one of said notches upon operation of said manually-operated mechanism; said second latching pin being seated in the other of said notches when said feeler member is in the projected position, and being unseated from said other of said notches when the feeler member is moved to its retracted position by its engagement with the door frame when the door is in its closed position.

4. The locking device according to claim 1, wherein said manually-operated mechanism comprises a key-operated cylinder for manually moving said first latching pin either to its first position latching said coupling member in its locking position, or to its second position releasing said coupling member from its locking position.

5. The locking device according to claim 1 wherein said coupling member is movable to its unlocking position by a lever arm coupled to the door handle when both said first and second latching pins are in their unlatching position.

6. The locking device according to claim 5, further including a spring interposed between said coupling member and said feeler member, for biassing the latter to a projected position to engage the door frame when the coupling member is in its unlocking position.

7. The locking device according to claim 4, further including a spring biassing said first latch pin in its first position latching said coupling member in its locking position; and retaining means effective, when actuated, to retain said first latching pin in its second position unlatching said coupling member.

8. The locking device according to claim 7, wherein said retaining means comprises an element secured to and movable within said first latching pin and engageable with an element carried by said key-operated cylinder for retaining said first latching pin in its second position when the key-operated cylinder is rotated by the key.

9. The locking device according to claim 7, wherein said retaining means comprises a foot pedal coupled to said first latching pin to retain same in its unlocking position when the foot pedal is depressed.

10. The locking device according to claim 1, wherein said coupling member is a coupling bar movable vertically either to a lower position to move said locking bolt to its locking, projected position, or to an upper position to move said locking bolt to its unlocking, retracted position.

11. The locking device according to claim 10, wherein said coupling bar is coupled to said locking bolt by a bell-crank lever which converts the vertical movement of the coupling bar to a horizontal movement of the locking bolt.

12. The locking device according to claim 11, wherein said locking bolt is of substantial vertical length, of at least 25% of the vertical length of the door itself, and is coupled to said coupling bar by a plurality of said bell-crank levers.

13. The locking device according to claim 12, wherein there are two of said locking bolts in vertical alignment, and both of substantial vertical length such that together they occupy at least 50% of the door height, both of said locking bolts being coupled to said coupling bar by a plurality of said bell-crank levers.

14. The locking device according to claim 13, wherein both of said locking bolts are coupled to said coupling bar by a pair of slide bars coupled to the opposite ends of said coupling bar so as to be movable vertically therewith, said bell-crank levers being pivotably mounted at one of their ends to said slide bars, and at their opposite ends to said locking bolts.

* * * * *